United States Patent [19]

Bergmark

[11] Patent Number: 4,879,773

[45] Date of Patent: Nov. 14, 1989

[54] SHOWER CABINET

[76] Inventor: Nils R. Bergmark, Ringvägen 14, S-930, 47 Byske, Sweden

[21] Appl. No.: 194,570

[22] PCT Filed: Sep. 14, 1987

[86] PCT No.: PCT/SE87/00414

§ 371 Date: May 11, 1988

§ 102(e) Date: May 11, 1988

[87] PCT Pub. No.: WO88/01843

PCT Pub. Date: Mar. 24, 1988

[30] Foreign Application Priority Data

Sep. 16, 1986 [SE] Sweden ..... 8603903

[51] Int. Cl.[4] ..... A47K 3/22

[52] U.S. Cl. ..... 4/612; 4/604; D23/305

[58] Field of Search ..... 4/596, 597, 598, 599, 4/600, 601, 602, 603, 604, 605, 607, 610, 611, 612, 614, 524, 557, 663, 664, 596–614; D23/271, 275, 279, 283, 303–306; 128/365–367

[56] References Cited

U.S. PATENT DOCUMENTS

| | | | |
|---|---|---|---|
| 1,008,957 | 11/1911 | Cox | 4/599 |
| 3,587,118 | 6/1971 | Compton | 4/604 |
| 3,630,193 | 12/1971 | Lancaster | 4/611 X |
| 3,955,239 | 5/1976 | Grossman | 4/607 X |
| 4,491,990 | 1/1985 | Robinson et al. | 4/607 |
| 4,564,963 | 1/1986 | Bergmark | 4/597 |
| 4,569,092 | 2/1986 | Baus | 4/596 |

FOREIGN PATENT DOCUMENTS

| | | | |
|---|---|---|---|
| 2245137 | 9/1972 | Fed. Rep. of Germany . | |
| 3301044 | 6/1984 | Fed. Rep. of Germany . | |
| 0845280 | 10/1938 | France | 4/612 |
| 2549361 | 1/1985 | France | 4/605 |
| 0645797 | 10/1984 | Switzerland | 4/596 |
| 2126879 | 4/1984 | United Kingdom | 4/605 |

*Primary Examiner*—Henry J. Recla
*Assistant Examiner*—J. Casimer Jacyna
*Attorney, Agent, or Firm*—Cushman, Darby & Cushman

[57] ABSTRACT

A shower cabinet having an entrance opening which is at least partially closed by a pivotable screen (6) made of a relatively rigid material, e.g. toughened glass. The invention deals with the problem of providing a shower cabinet that is equipped with auxiliary devices for assisting handicapped persons without detracting from the use of the cabinet as a conventional shower cabinet. This is achieved in accordance with the invention in that the screen (6) includes a stiffening or reinforcement strip (7) which is arranged along the vertical center line of the screen and the respective ends of which strip are journalled for rotation in the bottom part and the top part of that cabinet wall (2) which includes the entrance opening, and in that a raisable and lowerable seat (8) is pivotally mounted on the strip.

12 Claims, 2 Drawing Sheets

SHOWER CABINET

The present invention relates to a shower cabinet of the kind that has an entrance opening which is closed by means of a pivotable screen made of a relatively rigid material, e.g. toughened glass.

Because shower cabinets take up less floor space than conventional bath tubs, they are progressively replacing bath tubs when the space available therefore is confined. An object of the present invention is to provide a purposeful partial solution to the problem of constructing an all-round usable space for personal hygiene as a replacement for conventional bathrooms.

A particular object of the invention is to solve the problem of enabling a handicapped member of a family, e.g. a wheelchair-bound person, to use the shower cabinet for his own personal body hygiene, without this solution detracting from the possibility of the shower cabinet being used by the remaining members of the family, and without the auxiliary devices provided for the assistance of the handicapped person encroaching on the space externally of the shower cabinet.

In accordance with the invention this problem is solved by means of a shower cabinet having an entrance opening which is covered at least partially by a hinged screen made of relatively hard material, e.g. toughened glass, characterized in that the screen includes a stiffening or reinforcement strip which is arranged along the vertical centre line of the screen and the respective ends of which strip are journalled for rotation in the upper and the lower part of the cabinet wall that incorporates the entrance opening; and in that a raisable and lowerable seat is attached to the strip.

This construction enables a wheelchair-bound person to swing himself into the shower cabinet unaided and to see to his personal body hygiene without assistance and without requiring the provision of separate auxiliary devices therefore. This represents a great advantage, since there is often insufficient room for such devices in confined spaces, such confined spaces being the primary area of use for the inventive shower cabinet. Furthermore, since the seat can be lifted to a vertical position it will not, when lifted, encroach on the available space inside and outside the cabinet. It is mentioned in this connection that the term "handicapped" is meant to apply to all persons who for some reason or another need to be seated when showering, e.g. in order to wash the soles of the feet without needing to balance on one leg.

In order to assist a wheelchair-bound person to lift himself from his wheelchair and onto the seat, a handle is arranged on the strip at a location above the seat, in accordance with the preferred embodiment of the invention.

Furthermore, in this preferred embodiment a fan dryer is arranged in the shower cabinet, so as to assist the handicapped person in drying himself. This prevents the handicapped person from becoming cold upon finishing his shower and also obviates the need of swinging out of the shower while dripping wet in order to reach a towel, placed at some suitable readily reached location, preferably on the wheelchair.

According to a further feature of the invention, the shower screen is provided on the side thereof opposite the seat-carrying strip with a further strip of similar profile to the strip on which the seat is fitted. This further strip supports suitable attachment means for washing hangers. This enables the fan dryer to be used to accelerate the drying of washing when the cabinet is not being used for showering purposes.

These further features of the invention and advantages afforded thereby will become more apparent from the following detailed description of a preferred embodiment of the invention made with reference to the accompanying drawings, of which FIG. 1 is a schematic perspective view of a shower cabinet constructed in accordance with the invention;

Figure 1:
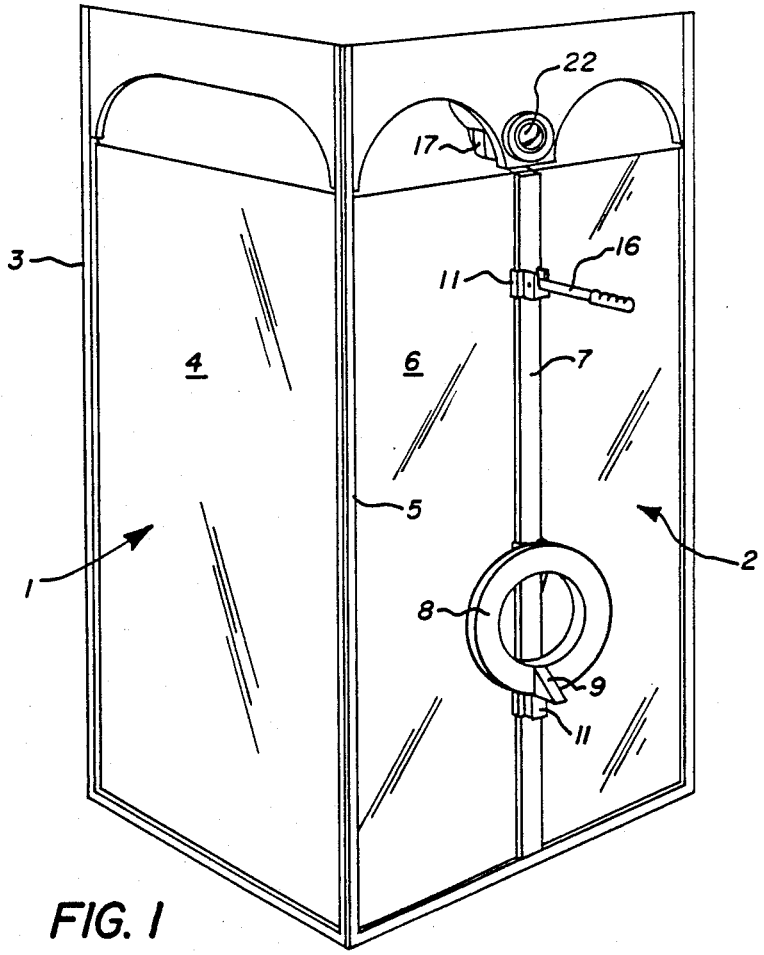

FIG. 1 illustrates schematically a preferred embodiment of the shower cabinet according to the invention. The illustrated cabinet comprises two walls 1, 2, which define a shower space together with two corner walls of the room in which the cabinet is placed. The wall is fixed and comprises a frame 3 in which a shower screen 4 is fitted.

The wall 2 also includes a fixed frame 5, but the shower screen 6 co-acting with this frame is rotatable about a vertically extending centre axis in order to permit entry to the shower space. The shower screens 4, 6 are manufactured from a relatively rigid material, preferably toughened glass.

A stiffening or reinforcement strip 7 extends along the vertical centre line of the screen 6, and is provided at the ends thereof with journal means which co-act with complementary journal means fitted to the frame. The journal means may be of any suitable kind and do not form any part of the present invention, although there is preferably selected a journal device which has two distinctive stop positions or rest positions opposed through 180° to one another, in order to prevent unintentional rotation of the screen. Such journal devices are well known to those skilled in the art.

The strip 7 carries a raisable and lowerable seat 8, which is shown in FIG. 1 in its raised position. The mechanism which enables the seat to be raised or lowered can be of any suitable kind and, for instance, may comprise a hinge means which is spring biassed towards the raised and the lowered position of the seat, i.e. a spring mechanism of the kind which has an unstable neutral position. In the embodiment illustrated in FIG. 1, the extent to which the seat can be lowered is restricted by a stop shoulder 9, whereas in the embodiment illustrated in FIG. 4 the extent to which the seat can be lowered is restricted by means of a telescopic rod assembly 10 which supports the outer end of the seat in the lowered position thereof. It is mentioned in this connection that if a seat raising and lowering mechanism is used which is not spring biassed in a direction towards the raised position of the seat, latching means may be provided for holding the seat in its raised position. Such latching means may conveniently be provided with a snap action, so as to enable the seat to be readily lowered. In the case of the FIG. 4 embodiment, the latching function can be achieved by resistance of the tubular parts of the telescopic rod to relative displacement.

Figure 2:
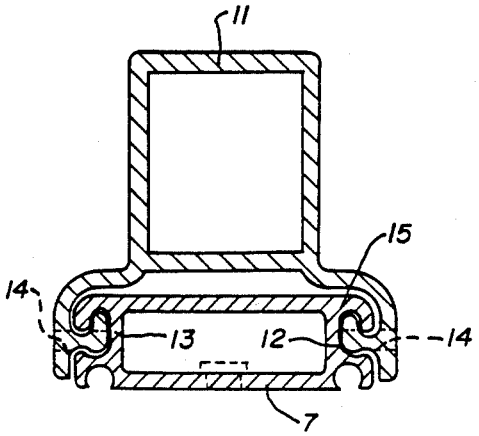
FIG. 2 illustrates the cross-sectional profiles of a cabinet stiffening or reinforcement strip and of an attachment device co-operating therewith.

FIG. 2 illustrates the cross-sectional profile of the strip 7 and an attachment device 11 co-operating therewith. As illustrated in the Figure, the side surfaces of the strip 7 have provided therein guide channels 12 which receive guide shoulders 13 projecting inwardly from the side surfaces of the attachment device 11. The fit between the shoulders 13 and the channels 12 is such as to enable the attachment device to be displaced along the channels. Furthermore, the square-tubular part of the attachment means is adapted to the element which is to be supported thereby. Thus, the lower attachment device 11 of the FIG. 1 embodiment is conveniently formed in a manner to include the hinge (not shown in the Figures), whereas the upper attachment device 11 in FIG. 1 is provided with a slot for guiding the swinging motion of a handle or gripping bar 16 pivotally mounted to said attachment means.

The upper part of the frame 5 supporting the screen 6 has mounted thereon a fan dryer 17, the fan housing of which is intimated in the drawings. This fan is placed on the inside of the upper frame part and is directed towards the location in which the seat 6 is positioned when the screen 6 is rotated through 180° from the position illustrated in FIG. 1, i.e. to one of its rest positions.

When the occupant of a wheelchair wishes to use the shower cabinet, he positions his wheelchair adjacent the seat 8. He then lowers the seat against the action of the spring mechanism, until the unstable neutral position has been passed, or against the action of the frictional force exhibited by the telescopic tubular parts of the alternative FIG. 4 embodiment. The wheelchair-bound person is then able to lift himself from his wheelchair onto the seat 8 with the aid of the handle 16. He then switches on the fan dryer 17, the operating means 22 of which being optionally supplemented with a pull cord or the like, to increase accessibility. The person concerned is then able to rotate the screen through 180°, to the second rest position of the screen, by supporting himself against the frame 5 with his hand, or hands, whereafter he is able to see to his personal body hygiene. Upon completing his shower, or body hygiene, and subsequent to drying the moisture from his skin, the person is able to re-seat himself in his wheelchair by executing the aforedescribed movements in reverse.

Because the seat and the handle can be raised and lowered, they will not encraoch upon the available space within or externally of the shower cabinet, and hence the cabinet can be used as a conventional shower cabinet for those who wish to shower whilst standing. It will be understood that the seat may also be used in the lowered position for, e.g., feeding washing into a nearby washing machine while seated in a comfortable position.

Figure 3:
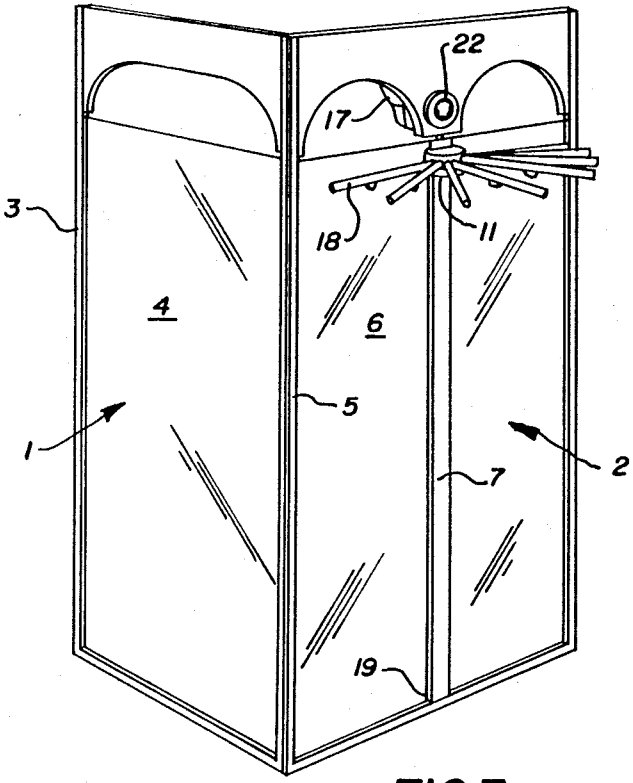
FIG. 3 is a perspective view of the shower cabinet with the screen rotated through an angle of 180° from the position illustrated in FIG. 1.

FIG. 3 illustrates the shower cabinet of FIG. 1 with the screen 6 rotated through 180°, i.e. to the second rest position in which the seat 8 is located within the cabinet. It will be seen from FIG. 3 that this side of the screen is also provided with a stiffening or reinforcement strip 7, which has a profile identical to the profile of the strip on the opposite side of the screen. The Figure also shows an attachment device 11 which is intended to support a plurality of washing hangers in the form of looped devices 18. The attachment device is securely mounted in the vertical direction with the aid of clamping screws which are screwed into screwthreaded holes 14 in the flange part of the attachment device, c.f. FIG. 2 in which the holes 14 are indicated in broken lines. It is also indicated in FIGS. 2 and 3 that the strip 7 includes a part 19 which lacks upper flanges 15, in order to enable attachment devices 11 to be fitted to an assembled cabinet wall 2.

The strips are preferably secured with the aid of throughpassing bolts which extend through bores provided in the screen and in that part of the wall of the hollow profiles of the strip 7 located nearest the screen. Openings in which tools can be used are loacted in the outer wall parts of the hollow profiles opposite the aforementioned bores. It will be understood that the strips may be secured in other ways, for example by bonding with an adhesive or by a combination of screw joints and adhesive bonds.

Figure 5:
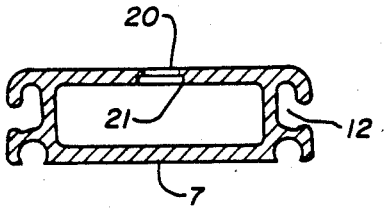
FIG. 5 illustrates the cross-sectional profile of the strip 7 of FIG. 1 in the region of the seat.

The respective displaceable attachment devices 11 for the seat 8 and the handle 16 can be secured in an adjusted vertical position by means of screw joints. A strip profile suitable to this end is illustrated in FIG. 5. It will be seen from this Figure that an opening 20 is provided in the outwardly facing wall of the hollow profile 7, this opening having the form of a slot which extends along the desired length of adjustment for the seat or handle. The slot 20 has provided therein a part 21 of step-shaped cross-section, so as to enable a nut threaded onto a bolt to slide in the slot part 21 when an attachment means is displaced axially in the groove 12 and thereafter secured in a desired position by tightening the bolt.

It will be understood that methods for securing the attachment devices other than those described can be applied within the scope of the invention and that the described joints are only mentioned by way of example.

Figure 4:
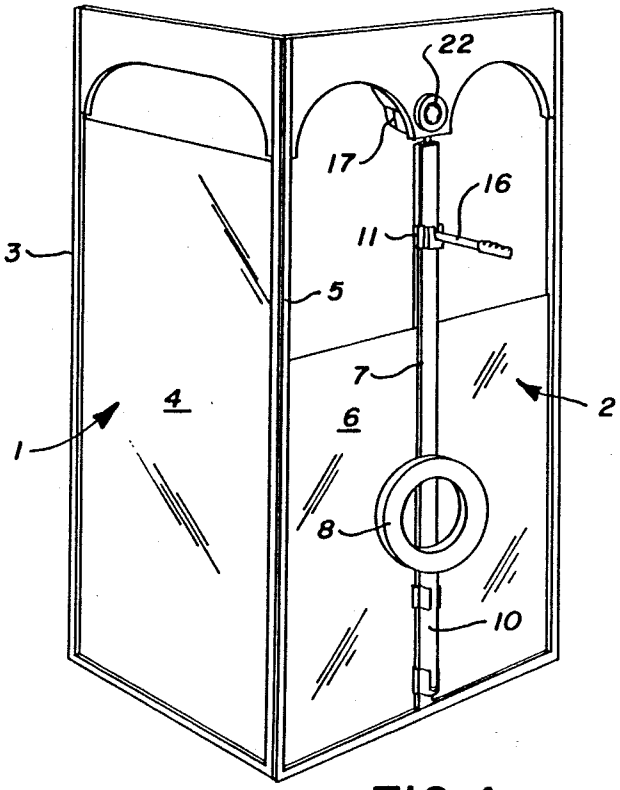
FIG. 4 illustrates schematically a further embodiment of the invention.

The inventive embodiment illustrated in FIG. 4 is intended for seriously handicapped persons and differs from the embodiment illustrated in the remaining Figures by the fact that the shower screen 6 only extends along the lower part of the strip 7. This enables a person to stand protected outside the shower cabinet while assisting the handicapped person in his body care. In this embodiment the upper attachment device may support a winch instead of the handle 16.

It will be seen from the Figures that the shower screens 4, 6 are rectangular in shape whereas the upper parts of the frames 3, 5 are arcuate. The purpose of the free space between the screens and the upper part is partly to provide a larger entrance opening in the vertical direction than that which is afforded by the positioning of the outer operating means 22 of the fan, which should be readily accessible even to persons of shorter height, and partly to permit good circulation between the air present in the cabinet and the air external thereof. If it is not possible for the cabinet to extend right up to the ceiling, the screens 4, 6 may, of course, be constructed so as to fully conform to the configuration of the openings in the frames 3, 5.

The invention thus provides an all-round usable shower cabinet which facilitates the body care of handicapped persons. The inventive solution is achieved with the aid of simple means and enables the auxiliary equipment for handicapped persons to be manufactured at such low costs as to enable the equipment to be used to enhance the comfort of non-handicapped persons without encroaching upon the use of the cabinet for those who wish to stand while showering.

It will be understood that the described shower cabinet can be modified in many ways within the scope of the invention, for example, by combining the wall 2 incorporating the entrance opening with stationary wall sections other than the wall 1. Furthermore, the elements incorporated in the construction may be replaced with other equivalent elements, for example, the attachment devices and their fixing elements may have a form different to that described.

Consequently, the scope of the invention is limited solely by the accompanying claims.

I claim:

1. A shower cabinet including a substantially floor length vertical opening means for ingress and egress therefrom, said shower cabinet comprising:

pivotable door screen means operable to allow said ingress or egress, said door screen means including stiffening strip means formed along a vertical center line of at least one face of said screen means;

said stiffening strip means comprising pivotal support means for pivotally attaching said door screen means on a vertical axis at its center whereby said door screen means are operable to rotate substantially 180 degrees on said axis, said axis disposed within said full length vertical opening means, and;

said stiffening strip means further comprises selectable seat means disposed on said strip means.

2. A shower cabinet according to claim 1, wherein said stiffening strip means further comprises parallel guide groove means, said guide groove means formed longitudinally with said strip means to accept at least one attachment means within said guide groove means.

3. A shower cabinet according to claim 2, wherein said selectable seat means is disposed on said at least one attachment means.

4. A shower cabinet according to claim 3, wherein said selectable seat means is disposed on said at least one attachment means by spring biasing means.

5. A shower cabinet according to claim 2, wherein washing hanger means are disposed on said at least one attachment means.

6. A shower cabinet according to claim 2, wherein at least one selectable handle means is disposed on said at least one attachment means.

7. A shower cabinet according to claim 2, wherein said attachment means includes clamping means.

8. A shower cabinet according to claim 2, wherein said attachment means includes throughbolt means.

9. A shower cabinet according to claim 1, further comprising at least one fan dryer means disposed on said shower cabinet, an output of said fan dryer means directed to said selectable seat means.

10. A shower cabinet according to claim 9, wherein said floor length opening means comprises mounting means for said fan dryer means, said fan dryer means mounted with said opening means thereby.

11. A shower cabinet according to claim 1, wherein said floor length opening means further comprises ambient air circulation means.

12. A shower cabinet according to claim 1, wherein said door screen means is comprised of toughened glass.

* * * * *